US008299969B2

(12) United States Patent
Chang et al.

(10) Patent No.: US 8,299,969 B2
(45) Date of Patent: Oct. 30, 2012

(54) MULTIBAND ANTENNA

(75) Inventors: Hao-Ying Chang, Taoyuan (TW); Yi-Hsien Weng, Taoyuan (TW); Cheng-Ang Lee, Taoyuan (TW)

(73) Assignee: FIH (Hong Kong) Limited, Kowloon (HK)

( * ) Notice: Subject to any disclaimer, the term of this patent is extended or adjusted under 35 U.S.C. 154(b) by 534 days.

(21) Appl. No.: 12/627,045

(22) Filed: Nov. 30, 2009

(65) Prior Publication Data

US 2010/0245203 A1 Sep. 30, 2010

(30) Foreign Application Priority Data

Mar. 30, 2009 (CN) ..... 2009 1 0301227

(51) Int. Cl.
*H01Q 1/38* (2006.01)

(52) U.S. Cl. ..... 343/700 MS; 343/702; 343/765; 343/764

(58) Field of Classification Search ..... None
See application file for complete search history.

(56) References Cited

U.S. PATENT DOCUMENTS

| | | | | |
|---|---|---|---|---|
| 6,963,310 | B2 * | 11/2005 | Horita et al. | 343/702 |
| 2005/0055164 | A1 * | 3/2005 | Neff et al. | 702/14 |
| 2005/0280587 | A1 * | 12/2005 | Svigelj et al. | 343/702 |
| 2008/0198075 | A1 * | 8/2008 | Yoshioka | 343/700 MS |
| 2011/0117976 | A1 * | 5/2011 | Nishikido et al. | 455/575.3 |

FOREIGN PATENT DOCUMENTS

| | | | |
|---|---|---|---|
| CN | 101779330 | A | 7/2010 |
| WO | WO 2009/022385 | * | 2/2009 |

* cited by examiner

*Primary Examiner* — Trinh Dinh
(74) *Attorney, Agent, or Firm* — Altis Law Group, Inc.

(57) ABSTRACT

A multiband antenna includes a radio unit and a base circuit board. The radio unit includes a first radio member and a second radio member connected to the first radio member. The first radio member and the second radio member have similar shapes and sizes to each other and are aligned with each other. The base circuit board is connected to the second radio member to provide feed signals to the radio unit and connect the radio unit to the ground. The first radio member independently sends/receives wireless signals at a first frequency, and the second radio member is coupled with the first radio member, thereby cooperating with the first radio member to send/receive wireless signals at a second working frequency.

13 Claims, 3 Drawing Sheets

MULTIBAND ANTENNA

RELATED APPLICATIONS

This application claims priority under 35 U.S.C. 119 from CHINA 200910301227.9 filed Mar. 30, 2009, the contents of which are incorporated herein by references.

BACKGROUND

1. Technical Field

The present disclosure relates to multiband antennas, and particularly to a multiband antenna used in portable electronic devices.

2. Description of Related Art

Nowadays, portable electronic devices, such as mobile phones, personal digital assistants (PDA) and laptop computers, are widely used. Most of these portable electronic devices have antennas mounted therein for receiving/sending wireless signals. Commonly, a portable electronic device may receive/send wireless signals of different frequencies, which requires its antenna be a multiband antenna. For example, many portable electronic devices need a multiband antenna that can receive/send wireless signals used in Global Position System (GPS) (at frequencies of about 1.575 G Hz) and can also receive/send wireless signals used in Wireless Fidelity (WIFI) (at frequencies of about 2.4 G Hz-2.5 G Hz).

However, many multiband antennas have complicated structures and are large in size, making it difficult to miniaturize portable electronic devices. Even if some miniaturized multiband antennas can be installed in the portable electronic devices, they are difficult to be installed precisely. Thus, communication quality of the portable electronic devices may be adversely affected.

Therefore, there is room for improvement within the art.

BRIEF DESCRIPTION OF THE DRAWINGS

Many aspects of the present multiband antenna can be better understood with reference to the following drawings. The components in the various drawings are not necessarily drawn to scale, the emphasis instead being placed upon clearly illustrating the principles of the present multiband antenna. Moreover, in the drawings, like reference numerals designate corresponding parts throughout the figures.

DETAILED DESCRIPTION

Figure 1:
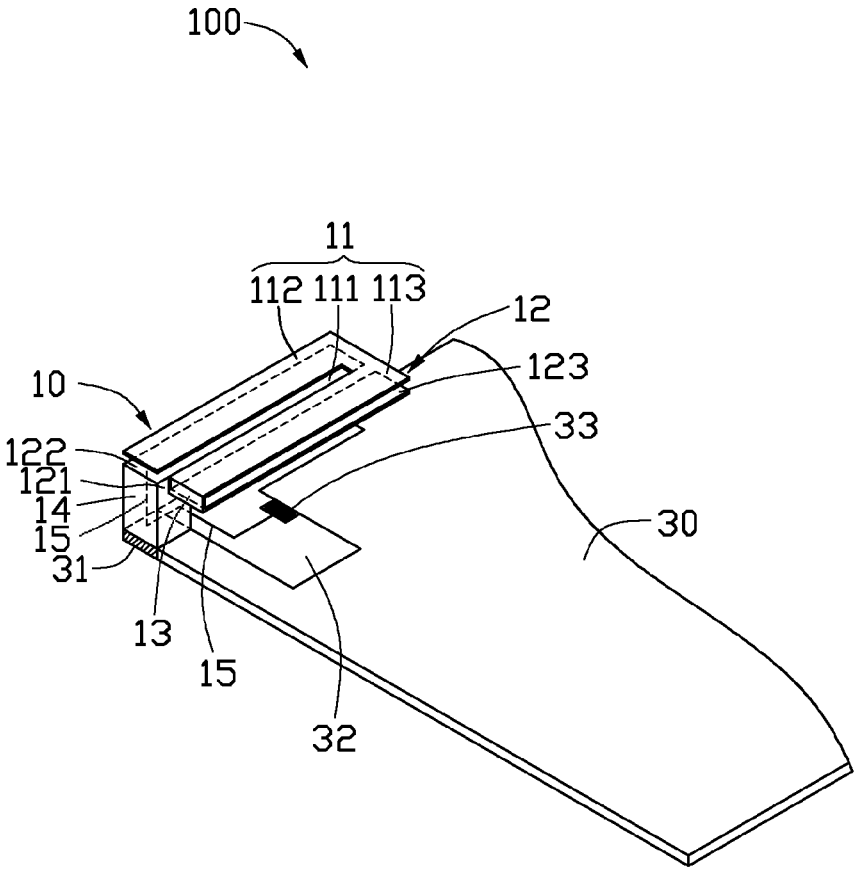
FIG. 1 is a schematic view of a multiband antenna, according to an exemplary embodiment.
Figure 2:
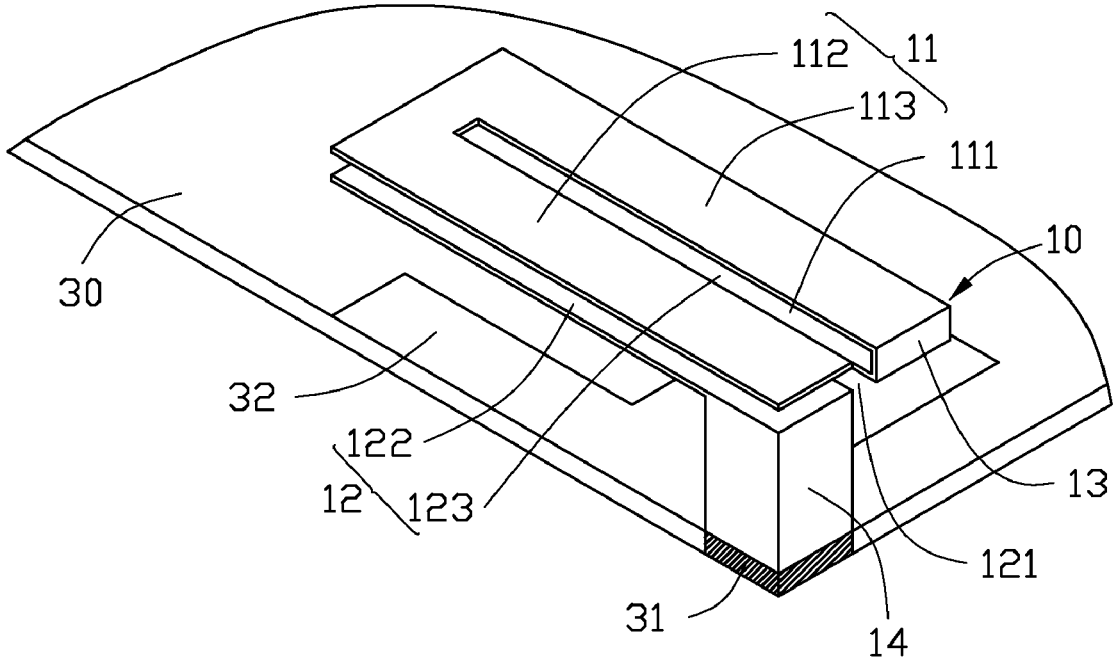
FIG. 2 is a schematic view of the multiband antenna shown in FIG. 1, shown in another view angle.

FIG. 1 and FIG. 2 schematically show a multiband antenna 100, according to an exemplary embodiment. The multiband antenna 100 includes a radio unit 10 and a base circuit board 30.

The base circuit board 30 is a flat sheet, which can be a part of a printed circuit board (PCB) of a portable electronic device. A relative permittivity of the base circuit board 30 is about 4.3, a loss tangent of the base circuit board 30 is about 0.02, and a thickness of the base circuit board 30 is about 0.06 inches. The base circuit board 30 includes a connecting area 31, an insulating area 32, and a matching circuit 33. The connecting area 31 is made of conductive materials (e.g., metals or conductive inks) disposed on an outer surface of the base circuit board 30. The radio unit 10 can be electrically connected to the connecting area 31, and then receive feed signals from the base circuit board 30 and be connected to the ground through the base circuit board 30. The insulating area 32 is also formed on the outer surface of the base circuit board 30 and is positioned adjacent to the connecting area 31 to protect the multiband antenna 100 from outside electromagnetic interference. The matching circuit 33 can be a conventional Π type matching circuit or T type matching circuit installed in the insulating area 32 and electrically connected to the connecting area 31 by the base circuit board 30. In use, the radio unit 10 can be electrically connected to the matching circuit 33 by the connecting area 31 to obtain a desired impedance match.

The radio unit 10 includes a first radio member 11, a second radio member 12, a connecting member 13, and a holding member 14.

The first radio member 11, the second radio member 12, and a connecting member 13 are all made of conductive materials, such as metal. The first radio member 11 is a rectangular planar sheet positioned parallel to the base circuit board 30. The first radio member 11 defines a first slot 111 in a middle portion thereof, and a first arm portion 112 and a second arm portion 113 are correspondingly formed at two sides of the first slot 111. The first arm portion 112 and the second arm portion 113 are both longitudinal sheets and are positioned parallel to each other. An end of the first arm portion 112 is connected to an end of the second arm portion 113. Another end of the first arm portion 112 and another end of the second arm portion 113 are separated from each other by the first slot 111.

The second radio member 12 is a rectangular planar sheet positioned parallel to the first radio member 11 and the base circuit board 30. The second radio member 12 has a shape and a size similar to the shape and size of the first radio member 11. Particularly, the second radio member 12 defines a second slot 121 in a middle portion thereof, and a third arm portion 122 and a fourth arm portion 123 are correspondingly formed at two sides of the second slot 121. An end of the third arm portion 122 is connected to an end of the fourth arm portion 123. Another end of the third arm portion 122 and another end of the fourth arm portion 123 are separated from each other by the second slot 121. The second slot 121, the third arm portion 122, and the fourth arm portion 123 have shapes and sizes similar to that of the first slot 111, the first arm portion 112, and the second arm portion 113, correspondingly. The first radio member 11 and the second radio member 12 are aligned with each other, such that the orthographic projections of the first radio member 11 and the second radio member 12 on the base circuit board 30 coincide with each other.

The connecting member 13 is a planar sheet. The connecting member 13 is perpendicularly connected between the end of the second arm portion 113 separated from the first arm portion 112 and the end of the fourth arm portion 123 separated from the third arm portion 122, thereby connecting the first radio member 11 to the second radio member 12.

The holding member 14 is a perpendicularly connected between the end of the third arm portion 122 that is separated from the fourth arm portion 123 and the connecting area 31. The first radio member 11, the second radio member 12, and the connecting member 13 are held on the base circuit board 30 by the holding member 14. At least one electrical connecting component 15, such as a wire, is installed in the holding member 14, and the end of the third arm portion 122 is electrically connected to the connecting area 31 by the electrical connecting component 15. Thus, the radio unit 10 can receive feed signals and be connected to the ground by the holding member 14 and the connecting area 31, and can also be electrically connected to the matching circuit 33 by the connecting area 31 to obtain a desired impedance match. Additionally, the first radio member 11, the connecting member 13, and other portions of the second radio unit 12 can also be electrically connected to the base circuit board 30 by conventional methods to receive feed signals and be connected to the ground.

The multiband antenna 100 can be used in portable electronic devices, such as mobile phones, personal digital assistants (PDA), or laptop computers, etc. In use, the radio unit 10 is electrically connected to inner circuits (not shown) of a portable electronic device by the base circuit board 30, thus the radio unit 10 can be grounded and be provided with feed signals by the holding member 14 and the base circuit board 30. The matching circuit 33 can provide a desired impedance match to the multiband antenna 100.

When feed signals are input to the multiband antenna 100 from the holding member 14 and travel through the second radio member 12, the connecting member 13 and the first radio member 11, the radio unit 10 can generate at least two different resonating frequencies. Thus, the multiband antenna 100 can be used in wireless communication systems having at least two working frequencies. Particularly, the second radio member 12 can be coupled with the first radio unit 11, and then cooperate with the first radio member 11 to generate a resonating frequency of about 2.4 G Hz-2.5 G Hz, and the first radio member 11 can independently generate a resonating frequency of about 1.575 G Hz. Therefore, the multiband antenna 100 can send/receive wireless communication signals in at least the two above-mentioned frequencies, and thus the multiband antenna 100 can be used in wireless communication systems having different working frequencies, such as GPS (i.e., using wireless signals at frequencies of about 1.575 G Hz) and WIFI (i.e., using wireless signals at frequencies of about 2.4 G Hz-2.5 G Hz), etc.

Figure 3:
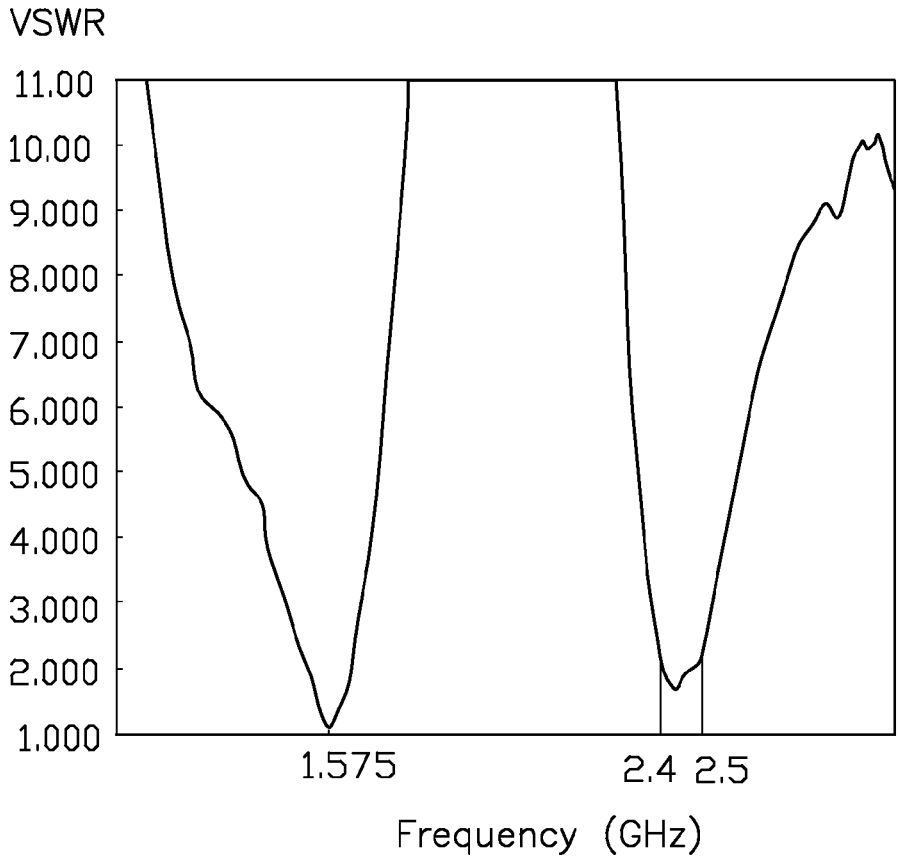
FIG. 3 is a diagram of measuring a voltage standing wave ratio (VSWR) of the multiband antenna shown in FIG. 1, in different working frequencies.

Referring to FIG. 3, which shows that when the multiband antenna 100 is respectively used to receive/send wireless communication signals in 1.575 G Hz, 2.4 G Hz, and 2.5 G Hz, the voltage standing wave ratio (VSWR) of the multiband antenna 100 is correspondingly about 1.37, 2.1 and 2.1. In the above-mentioned frequencies, the VSWR of the multiband antenna 100 is in an acceptable range. Additionally, when the multiband antenna 100 receives/sends wireless signals at frequencies of 1.575 G Hz, 2.4 G Hz, 2.45 G Hz and 2.5 G Hz, the radiation efficiency of the multiband antenna 100 is correspondingly 74.73%, 63.59%, 65.23% and 54.29%. In the four above-mentioned frequencies, the multiband antenna 100 is applicable in wireless communication. Therefore, the multiband antenna 100 can be used in both GPS and WIFI communications.

When the multiband antenna 100 is installed in a portable electronic device, the base circuit board 10 can be integrated with a conventional circuit board of the portable electronic device, and thus the multiband antenna 100 does not occupy much space. As above-mentioned, the multiband antenna 100 has good communication quality in at least GPS and WIFI communications and can be small in size, which can increase functions of portable electronic devices employing the multiband antenna 100, and can also allow further reductions in sizes of portable electronic devices employing the multiband antenna 100.

It is to be further understood that even though numerous characteristics and advantages of the present embodiments have been set forth in the foregoing description, together with details of structures and functions of various embodiments, the disclosure is illustrative only, and changes may be made in detail, especially in matters of shape, size, and arrangement of parts within the principles of the present invention to the full extent indicated by the broad general meaning of the terms in which the appended claims are expressed.

What is claimed is:

1. A multiband antenna, comprising:

a radio unit including a first radio member and a second radio member connected to the first radio member, the first radio member and the second radio member having similar shapes and sizes to each other and aligned with each other; and a base circuit board connected to the second radio member to provide feed signals to the radio unit and connect the radio unit to the ground; wherein the first radio member independently sends/receives wireless signals at a first frequency, and the second radio member is coupled with the first radio member, thereby cooperating with the first radio member to send/receive wireless signals at a second working frequency;

wherein the first radio member and the second radio member are both planar sheets positioned parallel to the base circuit board;

wherein the first radio member define a first slot therein, a first arm portion and a second arm portion are correspondingly formed at two sides of the first slot, an end of the first arm portion is connected to an end of the second arm portion, and another end of the first arm portion and another end of the second arm portion are separated from each other by the first slot;

wherein the second radio member define a second slot therein, a third arm portion and a fourth arm portion are correspondingly formed at two sides of the second slot, an end of the third arm portion is connected to an end of the fourth arm portion, and another end of the third arm portion and another end of the fourth arm portion are separated from each other by the second slot; and wherein the radio unit further includes a connecting member, and the connecting member is a planar sheet perpendicularly connected between the end of the second arm portion separated from the first arm portion and the end of the fourth arm portion separated from the third arm portion.

2. The multiband antenna as claimed in claim 1, wherein the base circuit board includes a connecting area connected to the radio unit and an insulating area positioned adjacent to the connecting area.

3. The multiband antenna as claimed in claim 2, wherein the base circuit board further includes a matching circuit connected to the radio unit.

4. The multiband antenna as claimed in claim 3, wherein the matching circuit is installed in the insulating area and is connected to the radio unit by the connecting area.

5. The multiband antenna as claimed in claim 1, wherein the orthographic projections of the first radio member and the second radio member on the base circuit board coincide with each other.

6. The multiband antenna as claimed in claim 1, wherein the radio unit further includes a holding member connected between the end of the third arm portion separated with the fourth arm portion and the base circuit board.

7. The multiband antenna as claimed in claim 1, wherein the first frequency is a frequency of wireless signals used in GPS communication.

8. The multiband antenna as claimed in claim 1, wherein the second frequency is a frequency of wireless signals used in WIFI communication.

9. A multiband antenna, comprising:

a radio unit including a first radio member and a second radio member connected to the first radio member; and a base circuit board connected to the second radio member to provide feed signals to the radio unit and connect the radio unit to the ground; wherein the orthographic projections of the first radio member and the second radio member on the base circuit board coincide with each other; the first radio member independently sending/receiving wireless signals at a first frequency, and the second radio member coupled with the first radio member, thereby cooperating with the first radio member to send/receive wireless signals at a second working frequency;

wherein the first radio member and the second radio member are both planar sheets positioned parallel to the base circuit board;

wherein the first radio member define a first slot therein, a first arm portion and a second arm portion are correspondingly formed at two sides of the first slot, an end of the first arm portion is connected to an end of the second arm portion, and another end of the first arm portion and another end of the second arm portion are separated from each other by the first slot;

wherein the second radio member define a second slot therein, a third arm portion and a fourth arm portion are correspondingly formed at two sides of the second slot, an end of the third arm portion is connected to an end of the fourth arm portion, and another end of the third arm portion and another end of the fourth arm portion are separated from each other by the second slot; and wherein the radio unit further includes a connecting member, and the connecting member is a planar sheet perpendicularly connected between the end of the second arm portion separated from the first arm portion and the end of the fourth arm portion separated from the third arm portion.

10. The multiband antenna as claimed in claim 9, wherein the base circuit board includes a connecting area connected to the radio unit and an insulating area positioned adjacent to the connecting area.

11. The multiband antenna as claimed in claim 10, wherein the base circuit board further includes a matching circuit connected to the radio unit.

12. The multiband antenna as claimed in claim 11, wherein the matching circuit is installed in the insulating area and is connected to the radio unit by the connecting area.

13. The multiband antenna as claimed in claim 9, wherein the radio unit further includes a holding member connected between the second radio member and the base circuit board.

* * * * *